United States Patent [19]

Ito et al.

[11] 4,369,752

[45] Jan. 25, 1983

[54] EXHAUST GAS PURIFICATION CONTROL APPARATUS FOR INTERNAL COMBUSTION ENGINE

[75] Inventors: Kosuke Ito, Yokohama; Hiroshi Iida, Tokyo; Masanori Harada; Masato Hatakenaka, both of Yokohama, all of Japan

[73] Assignee: Nissan Motor Co., Ltd., Yokohama, Japan

[21] Appl. No.: 190,282

[22] Filed: Sep. 24, 1980

[30] Foreign Application Priority Data

Sep. 27, 1979 [JP] Japan ..... 54-125143

[51] Int. Cl.[3] ..... F02M 25/06

[52] U.S. Cl. ..... 123/568; 123/571

[58] Field of Search ..... 123/568, 571

[56] References Cited

U.S. PATENT DOCUMENTS

| | | | |
|---|---|---|---|
| 3,800,766 | 4/1974 | Schubeck | 123/568 |
| 4,002,154 | 1/1977 | Kestner | 123/568 |
| 4,117,814 | 10/1978 | Takahashi | 123/568 |
| 4,193,381 | 3/1980 | Aoyama | 123/568 |

FOREIGN PATENT DOCUMENTS

| | | | |
|---|---|---|---|
| 9344 | 2/1980 | European Pat. Off. . | |
| 54-36425 | 3/1979 | Japan | 123/571 |
| 54-130725 | 10/1979 | Japan | 123/568 |
| 1305235 | 1/1973 | United Kingdom . | |
| 1527935 | 10/1978 | United Kingdom . | |
| 2023728 | 1/1980 | United Kingdom . | |

*Primary Examiner*—Wendell E. Burns

*Attorney, Agent, or Firm*—Thompson, Birch, Gauthier & Samuels

[57] ABSTRACT

An exhaust gas purification control apparatus for an internal combustion engine wherein vacuum signals applied to air fuel mixture control, exhaust gas recirculation control, and ignition timing control are modified by a vacuum signal modifier. The vacuum signal modifier is operative in response to a pressure signal applied thereto. This pressure signal is produced by a pressure signal control device by diluting a venturi vacuum with air.

4 Claims, 3 Drawing Figures

EXHAUST GAS PURIFICATION CONTROL APPARATUS FOR INTERNAL COMBUSTION ENGINE

BACKGROUND OF THE INVENTION

The present invention relates to an exhaust gas purification control apparatus for an internal combustion engine.

According to a known exhaust gas purification control apparatus, air-fuel mixture control, exhaust gas recirculation control, and ignition timing control are separately and independently modified in response to electric output signals produced by a vehicle speed sensor and an engine speed sensor to provide optimum operation during low speed or light load and optimum operation during high speed or heavy load. According to another known exhaust gas purification control apparatus, air-fuel mixture control, exhaust gas recirculation control, and ignition timing control are separately and independently modified by pressure which varies with engine speed. These known apparatuses are designed to enhance fuel economy and endurability against heat.

However, with the known control apparatuses, since the air-fuel mixture control, exhaust gas recirculation control, and ignition timing control are separately and independently modified, there occurs a knocking due to an excessive increase in combustion speed, for example, when the air-fuel mixture is enriched and exhaust gas recirculation is decreased under the condition that the ignition timing is still advanced, thus deteriorating fuel economy and driveability.

Additionally, although the control apparatuses use an intake passage vacuum in the vicinity of the throttle valve, this intake passage vacuum no longer represents engine load under high engine load since it is greatly affected by manifold vacuum prevailing downstream of the throttle valve as the throttle valve opens.

SUMMARY OF THE INVENTION

According to the present invention, at least two controls of an air-fuel mixture control, an exhaust gas recirculation control, and an ignition timing control are modified substantially simultaneously by a vacuum signal modifier. The vacuum signal modifier is operative to a pressure signal applied thereto to modify the vacuum signals. A pressure control device is provided for controlling the pressure signal applied to the vacuum signal modifier to operate same.

An object of the present invention is therefore to provide an exhaust gas purification control apparatus wherein fuel economy and driveability are enhanced and the required exhaust gas purification performance is met.

DETAILED DESCRIPTION OF THE INVENTION

Hereinafter, an embodiment according to the present invention will be precisely described in connection with the drawings.

Figure 1:
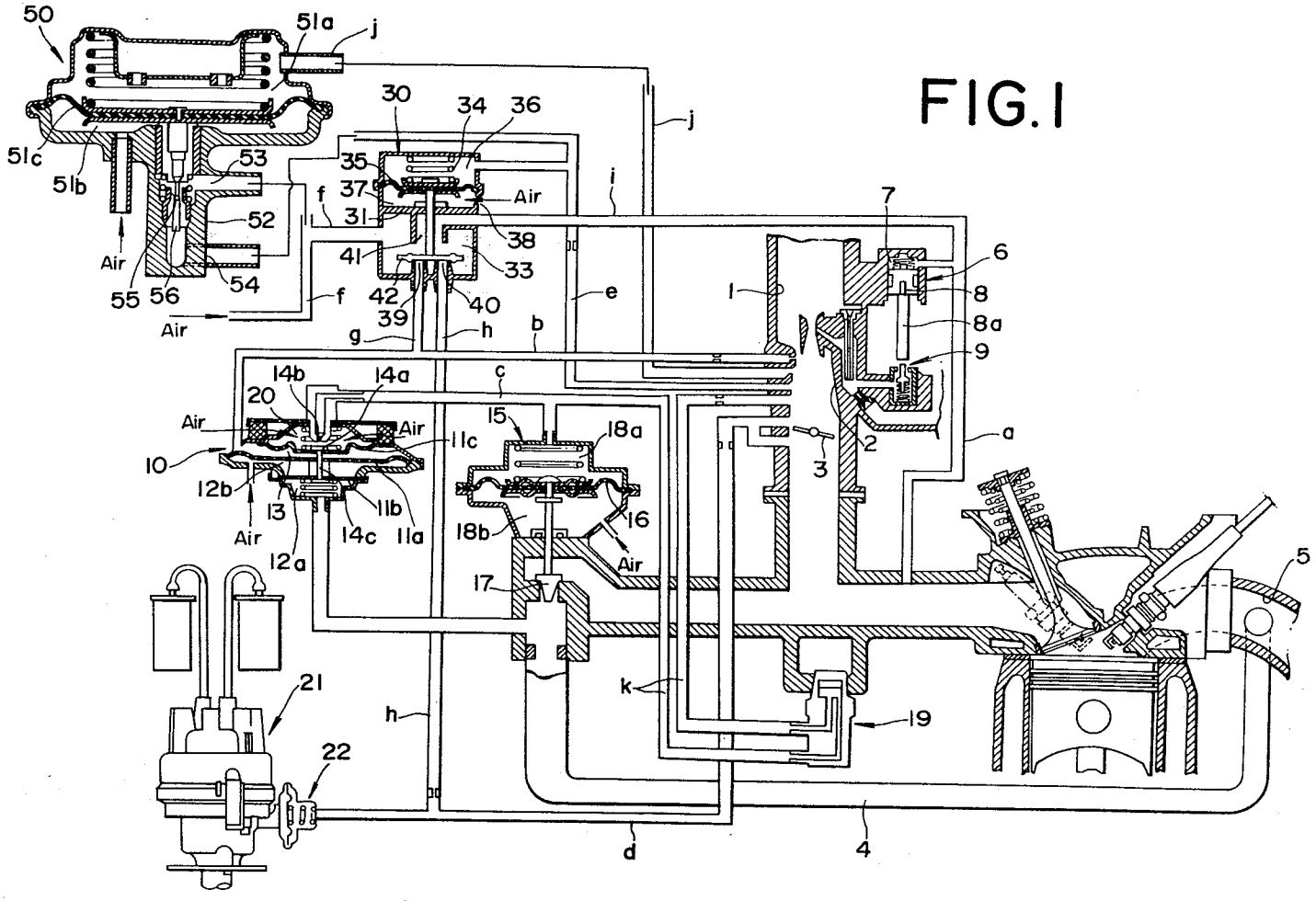
FIG. 1 is a diagrammatic view of a first embodiment of an exhaust gas purification control apparatus according to the present invention.

Referring to FIG. 1, there is illustrated a first embodiment of an exhaust gas purification control apparatus according to the present invention, wherein 1 denotes an intake passage connecting with an unillustrated air cleaner, the intake passage 1 having a venturi 2 and a throttle valve 3 arranged therein. 4 denotes an exhaust gas recirculation conduit communicating an exhaust passage 5 with the intake passage 1 at a position downstream of the throttle valve 3.

6 denotes an air fuel mixture control operable in response to a first signal vacuum, viz., manifold vacuum. The air-fuel mixture control is in the form of a power valve 6 to regulate the amount of fuel to be injected into the air intake passage 1 in response to the first vacuum signal, viz., manifold vacuum. The power valve 6 is constructed and arranged such that a piston 8 fits within a vacuum chamber 7 communicating with an intake manifold through a conduit a and wherein upward and downward movement of the piston in response to a variation in vacuum in the intake passage 1 causes a rod 8*a* to vary the opening area of a jet 9, thus adjustably enriching, the air-to-fuel ratio of the mixture to be supplied to the engine.

An exhaust gas recirculation control comprises a venturi vacuum transducer (V.V.T.) valve 10 and an exhaust gas recirculation (E.G.R.) control valve 15. The exhaust gas recirculation control is operative in response to a second vacuum signal, viz., a venturi vacuum in a conduit b.

Referring to the V.V.T. valve 10, it monitors the exhaust gas pressure and the venturi vacuum to regulate the vacuum supplied to the E.G.R. valve 15. The V.V.T. valve comprises three diaphragms 11*a*, 11*b*, and 11*c* which are interconnected by a rod 14*c*, and also comprises a lower chamber 12 below the diaphragm 11*b* communicating with the exhaust gas recirculation conduit 4 to monitor the exhaust gas pressure. Between the interconnected diaphragms 11*a* and 11*c* is defined a middle chamber 13 which communicates through the conduit b with the venturi 2 to monitor the venturi vacuum. A chamber 12*c* between the diaphragms 11*a* and 11*b* communicates with the ambient atmosphere.

Referring the E.G.R. valve 15, it is disposed in the exhaust gas recirculation conduit 4 to regulate the exhaust gas recirculation in response to the vacuum within a chamber 18*a* above a diaphragm 16. Below the diaphragm 16 is an atmosphere chamber 18*b*. The E.G.R. valve 15 comprises a valve 17 actuated by the diaphragm 16. The vacuum chamber 18*a* communicates with an E.G.R. vacuum port at a position upstream of and in the vicinity of the throttle valve 3 through a conduit K having a thermal vacuum (T.V.) valve 19.

The T.V. valve 19 is of a 2-port type and is mounted on the engine thermostat housing. It detects engine coolant temperature by means of a built-in bimetal, and opens or closes the conduit K. When the coolant temperature is higher than a predetermined value, the T.V. valve 19 opens the conduit k to allow the vacuum to be applied to the diaphragm 16 of the E.G.R. valve 15. When the coolant temperature is lower than the predetermined value, the conduit k is closed.

The chamber 18*a* of the E.G.R. valve 15 communicates also with an upper atmosphere chamber 20 of the V.V.T. valve 10 through a conduit c which opens into the atmosphere chamber 20 via a control orifice 14*b* valved by a valve 14. The air flow via the control orifice into the conduit c is regulated by the valve 14 fixed to the rod 14*c*.

Assuming that the exhaust gas pressure within the chamber 12*a* of the V.V.T. valve 10 is constant, an increase in the venturi vacuum acting within the chamber 13 causes the valve 14*a* to close the control orifice 14*b*, while, a decrease in the venturi vacuum causes the valve 14*a* to open the constant orifice 14*b*.

An ignition timing control is in the form of a vacuum advance device 22 operatively connected to the distributor 21, which vacuum advance device 22 is responsive to a third vacuum signal at a vacuum advance port opening to the intake passage 1 in the vicinity of the closing position of the throttle valve 3. The distributor 21 determines the engine ignition timing, which is adjusted by the vacuum advance device 22. To a diaphragm vacuum chamber of this vacuum advance device 22, a vacuum at the vacuum advance port is applied through a conduit d. The ignition timing advances as the vacuum applied to the vacuum chamber of the vacuum advance device 22 increases.

The first, second and third vacuum signals are modified by a vacuum signal modifier 30. In other words, the vacuum signal modifier 30 effects a package control of the power valve 6, V.V.T. valve 10, and vacuum advance device 22. The vacuum signal modifier 30 comprises two upper and lower chambers 32 and 33 divided by a partition wall 31. The upper chamber 32 is further divided by a downwardly loaded diaphragm 35 by a set spring 34 into a vacuum chamber 36 and an atmosphere chamber 37. The vacuum chamber 36 communicates with the venturi 2 through a conduit e. 38 denotes an atmosphere port. On the other hand, atmosphere air is introduced into the lower side chamber 33 through a conduit f. The lower chamber 33 is provided at the bottom portion with the ports 39 and 40 communicating respectively with conduits g and h which in turn communicate respectively with the conduits b and d, and is also provided at the top portion thereof with a port 41 communicating with a conduit i which in turn communicates with the conduit a. With these conduits g, h and i, the atmosphere air is allowed to act upon the V.V.T. valve 10, vacuum advance device 22 and power valve 6. Disposed between the bottom ports 39 and 40 and top port 41 is a switching valve 42 actuable by the diaphragm 35 to alternatively close the bottom ports 39 and 40 or top port 41.

The vacuum chamber 36 above the diaphragm 36 communicates with the atmosphere conduit f through a pressure control device in the form of a variable flow orifice 52, which flow restricting area is regulated by a diaphragm device 50. The diaphragm device 50 has an atmosphere chamber 51*b* below a diaphragm 51*c* and a vacuum chamber 51*a* above the diaphragm. The vacuum chamber 51*a* communicates with the venturi 2 through a conduit j to receive the venturi vacuum. Although in this embodiment, the venturi vacuum is applied to the vacuum chamber 51*a*, any vacuum may be applied to the vacuum chamber 51*a* as long as it represents the quantity of air flow through the venturi 2. The variable orifice 52 includes an atmosphere inlet port 53 communicating with the conduit f opening into the atmosphere, an atmosphere outlet port 54 communicating with the chamber 36 of the vacuum signal modifier 30, and an orifice 55 disposed between the inlet and outlet ports 53 and 54. Cooperating with the orifice 55 is a needle valve 56. The needle valve 56 is fixed to the diaphragm 51 and is in the form of an inverse taper with its bottom end enlarged and its tapered top end inserted into the orifice 55. If the venturi vacuum increases, the needle valve 56 is lifted to restrict air flow through the orifice 55 and if the venturi vacuum exceeds a predetermined value (for example, −18 mmHg), the needle valve 56 closes the orifice 55.

With the device constructed as above, the amount of atmosphere air passing through the variable orifice 55 is regulated in response to venturi vacuum, and the thus regulated amount of atmosphere air is introduced into the vacuum chamber 36 of the vacuum signal modifier 30 together with the venturi vacuum introduced into the vacuum chamber 36 via the conduit e. If then, the vacuum acting within this vacuum chamber 36 is lower than a predetermined value (for example, 31 =mmHg) for the vacuum signal modifier 30, the switching valve 42 closes the ports 39, 40 of the conduits g, h and opens the port 41 of the conduit i owing to the action of the set spring 34. Accordingly, in the case of the control of ignition timing, the vacuum at the throttle valve 3 only is introduced into the vacuum advance device 22 of the distributor 21 via the conduit d, thus advancing the ignition timing.

Referring nextly to the control of exhaust gas recirculation, since the venturi vacuum only is introduced via the conduit b into the middle vacuum chamber 13, the valve body 14 moves toward the upper atmosphere chamber 20 until it closes the control orifice 14*b* of the conduit c. This causes the venturi vacuum only to act via the conduit k within the exhaust gas recirculation valve 15, thus causing movement of the valve body 17 toward the vacuum chamber 18 to increase the amount of exhaust gas recirculation.

Lastly, in the case of the control of air fuel-mixture, the atmosphere pressure is introduced into the vacuum chamber 7 of the power valve 6, thus pushing the piston 8 as well as its rod 8*a* downwards, increasing the opening area of the jet 9 to cause an increase in supply of fuel, and, as a result, the air-fuel mixture is enriched to lower NOx and enhance the driveability.

If, on the other hand, the venturi vacuum applied via the conduit j to the operating control valve 50 exceeds an actuating predetermined vacuum value as the engine load increases, the valve body 56 of the variable orifice closes the orifice 57. This causes the venturi vacuum only to be introduced via the conduit e into the vacuum chamber 36 of the vacuum signal control valve 30, thus shifting the switching valve 42 toward the vaccum chamber 36 to close the upper port 41 and open the lower ports 39, 40. Accordingly, in the case of the control of ignition timing, the atmosphere air is applied via the conduit h to the vacuum advance device 22, thus retarding or reducing the advancement of the ignition timing, thus regulating the emission of NOx, HC and the like and reducing the occurrence of knocking.

Referring, nextly, to the control of exhaust gas recirculation, the atmosphere air is introduced via the conduit g into the middle vacuum chamber 13, thus shifting the valve body 14 downwards to allow the atmospheric pressure into the conduit c. Thus, the atmospheric pressure and the introduced vaccum via the conduit k cooperate to act within the vacuum chamber 18, thus displacing the valve body 17 in a direction to reduce the exhaust gas recirculation. If the setting is made to accomplish about 5% to 15% exhaust gas recirculation, the regulation of emission of NOx and driveability are compatible with each other.

Nextly, in the case of the control of air-fuel mixture, the vaccum within the vacuum chamber 7 of the power valve 6 is equal to the vacuum at a position within the intake passage 1 downstream of the throttle valve 3 because the introduction of the atmosphere air is shut off with the switching valve 42 so that piston 8 as well as its rod 8*a* are lifted to allow closure of the jet 9, thus leaning out the mixture to improve the fuel economy.

Although, in this embodiment, the ignition timing, exhaust gas recirculation, and air-fuel mixture are substantially simultaneously controlled, there is no intention to limit to this embodiment, and it is possible to substantially simultaneously control any selected number of control parameters.

Although, in this embodiment, V.V.T. 10 monitoring two signals, viz., venturi vacuum and exhaust pressure signals is used, it is not intended to limit the invention to this and a valve which monitors either the venturi vacuum or the exhaust pressure signal may be used, and the direct control is also possible wherein the E.G.R. valve 15 is directly controlled by the vacuum signal at the throttle valve 3.

Figure 3:
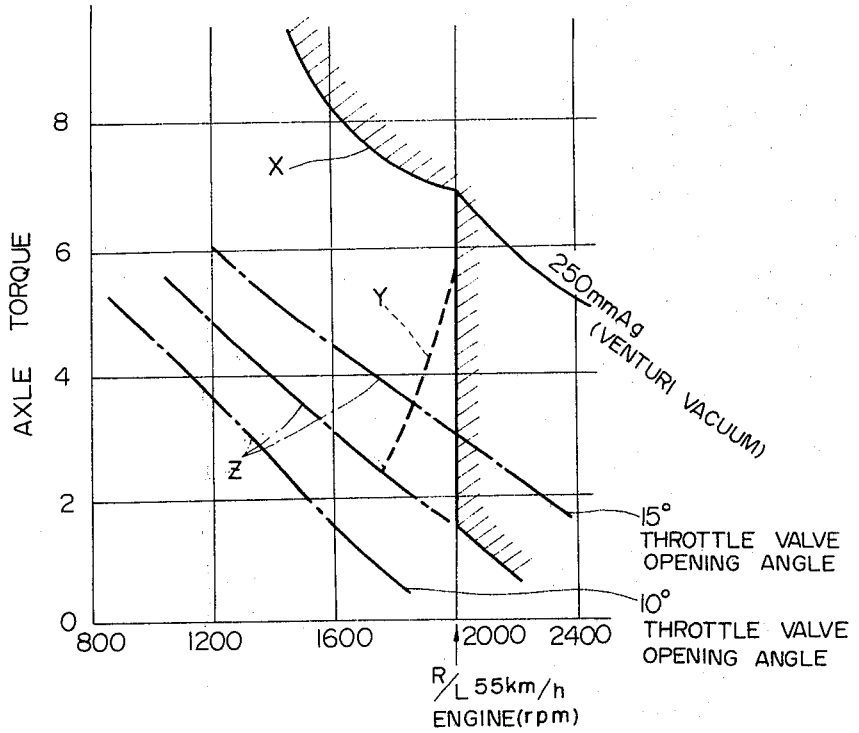
FIG. 3 is a graph showing axle torque vs. engine speed curves.

The operational states of the respective control mechanisms of the before mentioned embodiment according to the present invention are shown in TABLE 1 taking the operating conditions during running at substantially flat road at 80 km/h, and the operation boundary line X of the vacuum signal modifier 30 is shown in FIG. 3 in terms of the relationship between the axle torque of the engine and engine speed (r.p.m.). The operation boundary line X may be set as shown by the dashed line Y, if so desired. In this figure, the region indicated by oblique lines denotes an ON state of the vacuum signal control valve 30, that is, the switching valve 42 is shifted toward the vacuum chamber 36 to close the upper opening port 41 and open the lower opening ports 39 and 40, and chain lines Z indicate the opening degree of the throttle valve 3.

upstream of the venturi 2 and the opposite end connecting with a conduit e at a position between a vacuum chamber 36 of a vacuum signal modifier 30 and an orifice 154 disposed in the conduit e. Denoted by 156 is a vacuum delay valve which is designed for one-way operation for allowing air flow toward the vacuum chamber 36. It comprises a one-way umbrella valve 158 and sintered flow restrictor 160.

As has been described above, according to the present invention, at least two of the exhaust gas recirculation control, air-fuel mixture control and ignition timing control are modified simultaneously by a vacuum signal modifier and a pressure control device for controlling the pressure signal acting upon the vacuum signal modifier.

The following are practical effects achieved by the embodiments according to the present invention.

(1) Because expensive sensors, such as a vehicle speed sensor and an engine speed sensor are not used, the exhaust gas purification control apparatus is manufactured at a low cost.

(2) Because exhaust gas recirculation, air-fuel mixture, and ignition timing which cooperate with each other to determine the combustion speed of the engine are controlled in response to a pressure signal representing the amount of intake air and because this pressure signal represents the amount of intake air over the whole range of engine operation without receiving any influence of engine induction vacuum, the combustion speed of the engine is accurately controlled in response to the engine load so that fuel economy and exhaust gas purification performance are totally and effectively improved without any deterioration of driveability.

(3) Since the ignition timing retards simultaneously when exhaust gas recirculation decreases and air fuel mixture approaches the stoichiometry from the lean side, a knocking which otherwise would occur when the exhaust gas recirculation decreases and air fuel mixture approaches the stoichiometry from the lean side is prevented.

(4) A switching, in operation, of each of exhaust gas recirculation control, air fuel mixture control, and ignition timing control, is effected smoothly and gradually, thus considerably decreasing a shock upon such switching.

(5) The boundary at which a switching, in operation, of each of exhaust gas recirculation control, air fuel mixture control, and ignition timing control, takes place, can be freely selected only if the vacuum signal modifier and pressure signal control device are slightly modified, so that fuel economy, driveability, and endurability are enhanced without any deterioration of exhaust gas purification performance.

What is claimed is:

TABLE 1

| | Venturi 2 pressure | Pressure Control Valve 50 | Vacuum Signal Modifier 30 | V.V.T Valve 10 | EGR Valve 15 | Distributor 21 | Power Valve 6 |
|---|---|---|---|---|---|---|---|
| Invention | −19 mmHg (Above predetermined value) | Fully Closed | Valve seat 39,40 open Valve seat 41 closed | Pressure Signal Only | Exhaust low EGR (5~15%) | BTDC 30°~40° | closed A/F155 |
| Conventional | same | None | None | Exhaust Pressure, Venturi Pressure Signals | EGR 20~25% | BTDC 40°~50° | Open A/F135 |

Figure 2:
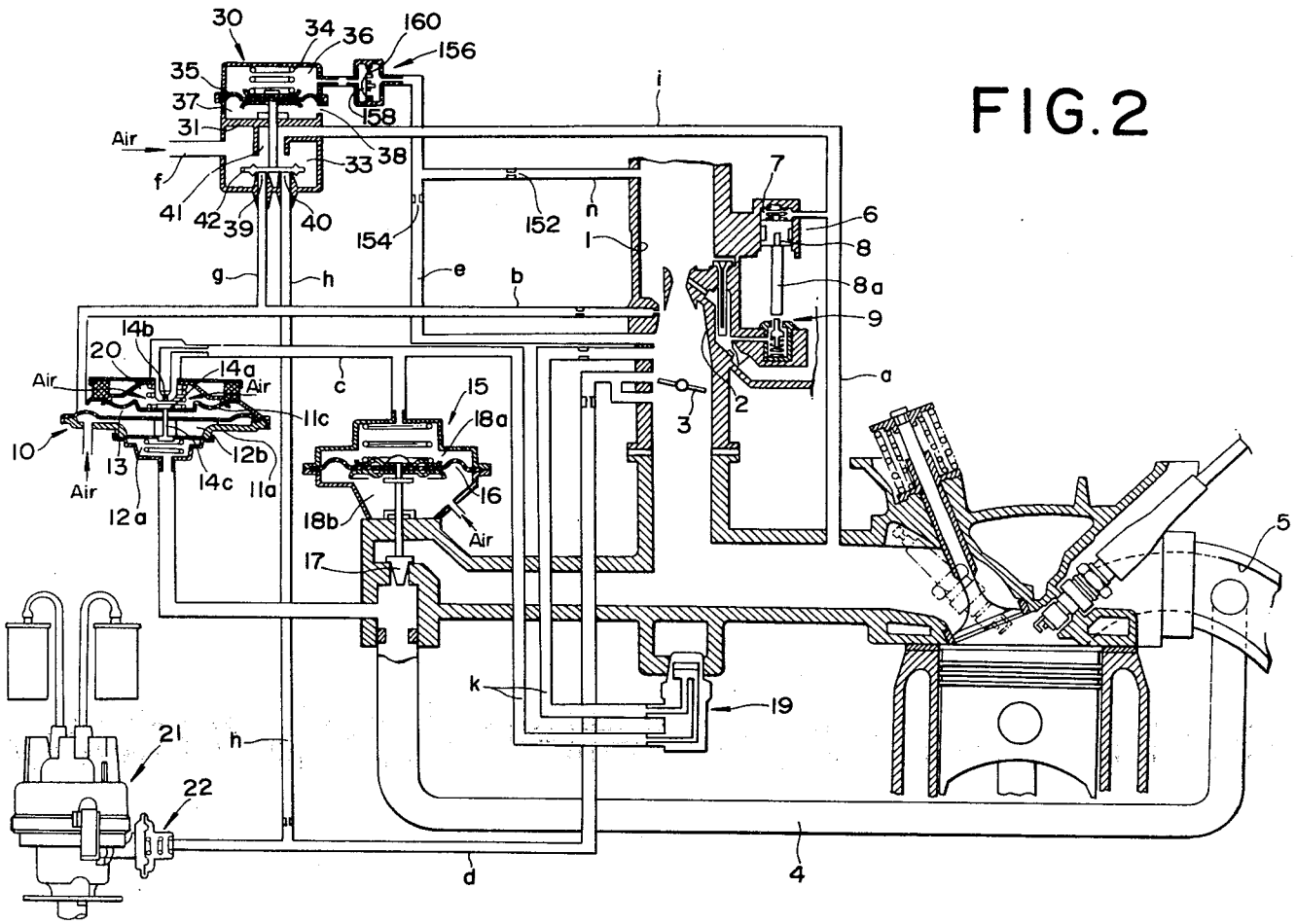
FIG. 2 is a view similar to FIG. 1, illustrating a second embodiment.

Referring to a second embodiment, shown in FIG. 2, of an exhaust gas purification control apparatus according to the present invention, this embodiment is substantially the same as the first embodiment except that in the place of the pressure control device taking the form of a variable orifice in the case of the first embodiment, a pressure control device takes the form of a fixed orifice 152 which serves as an air-bleed orifice for diluting the vacuum acting on the vacuum signal modifier. The operation is substantially the same as that of the first embodiment. The fixed orifice 152 is disposed in a conduit n having one end opening to the intake passage 1

1. An exhaust gas purification control apparatus for an internal combustion engine comprising:

(a) an air-fuel mixture control responsive to a first vacuum signal;

(b) an exhaust gas recirculation control responsive to a second vacuum signal;

(c) an ignition timing control responsive to a third vacuum signal;

(d) a vacuum signal modifier for controlling at least two of said first, second, and third vacuum signals in response to a pressure signal applied thereto; and (e) a pressure control device for controlling said pressure signal applied to said vacuum signal modifier.

2. An apparatus as claimed in claim 1, wherein said pressure control device comprises a fluid restricting flow orifice.

3. An apparatus as claimed in claim 2, wherein said fluid restricting flow orifice of said pressure control device is a variable flow orifice.

4. An apparatus as claimed in claim 2, wherein said fluid restricting flow orifice of said pressure control device is a fixed orifice.

* * * * *